United States Patent [19]

Hashimoto et al.

[11] Patent Number: 4,679,739

[45] Date of Patent: Jul. 14, 1987

[54] VERTICAL ROLLER MILL

[75] Inventors: Isao Hashimoto, Akashi; Tosuke Kinoshita; Masahiro Uchida, both of Kobe; Susumu Uchiyama, Nishinomiya, all of Japan

[73] Assignee: Kawasaki Jukogyo Kabushiki Kaisha, Kobe, Japan

[21] Appl. No.: 745,287

[22] Filed: Jun. 14, 1985

[30] Foreign Application Priority Data

Jun. 16, 1984 [JP] Japan ..... 59-124166

[51] Int. Cl.[4] ..... B02C 15/00

[52] U.S. Cl. ..... 241/121; 241/295

[58] Field of Search ..... 241/117–121, 241/293, 295

[56] References Cited

U.S. PATENT DOCUMENTS

Re. 25,552 4/1964 Berz ..... 241/118
3,591,094 7/1971 Gauer ..... 241/121 X

FOREIGN PATENT DOCUMENTS 1227762 10/1966 Fed. Rep. of Germany .
89375 6/1967 France .
71465 8/1979 Japan .
109146 6/1983 Japan .
85/00302 1/1985 PCT Int'l Appl. .

*Primary Examiner*—Mark Rosenbaum
*Attorney, Agent, or Firm*—Marshall, O'Toole, Gerstein, Murray & Bicknell

[57] ABSTRACT

A roller mill according to this invention includes a base and a table supported on the base, the table being adapted to be rotated on a generally vertical axis. The table has an annular groove formed in its top surface, the groove having a semicircular cross section. At least one roller is supported by the base above the table, each roller being rotatable on an axis which intersects with the vertical axis of the table. Each roller has an arcuate peripheral portion which forms part of a circle of curvature in cross section. The roller and the table rotate on their respective axes, and they are adapted to compress and mill material in the groove betweem them, a clearance which receives the material being formed between the peripheral portion of the roller and the groove. The roller has a wider axial dimension on the side which is inward radially of the table from a radial plane of the roller, this plane passing through the center of the circle of the peripheral part of the roller, than the axial dimension on the outward side of the table.

9 Claims, 6 Drawing Figures

VERTICAL ROLLER MILL

FIELD AND BACKGROUND OF THE INVENTION

The present invention relates to a vertical roller mill, and more particularly to a mill for final milling of clinker or blast furnace slag used as cement material.

FIG. 1 of the accompanying drawings shows a conventional vertical roller mill including a table 1 and a plurality of rollers 2, wherein each roller 2, which is in the general shape of a tire, has a central radial plane P that is perpendicular to the top surface of the rotary table 1 and that is perpendicular to the axis of rotation of the tire. Material to be milled or crushed is supplied to a central portion of the table 1, moved centrifugally outwardly to the rollers 2, and milled between the rollers and table.

Each roller 2 has a radial plane P located axially centrally thereof. The rollers are located in an annular groove formed in the upper surface of the table, and the clearance CL between the outer periphery of each roller 2 and the bottom of the groove is narrowest at the central plane P, where, also, the roller pressure is greatest. At substantially in the central plane P, the roller 2 and the table 1 rotate at the same circumferential speed.

This causes slips due to differences in the circumferential speed between adjacent portions of the roller and table, as shown graphically in FIG. 2, on both sides of the central plane P. The direction of the slip on one side of the plane P is opposite to that on the other side, and the slippage on the outer side of the plane P is far greater than that on the inner side. This increases the slipping force due to the roller pressure on the outer side, thereby causing an imbalance of forces on opposite sides of the plane P.

The force imbalance causes a large bending moment around the supporting pivot 5 for each roller, and requires the arm 3 which supports each roller to be very rigid. The imbalance due to the slippage also causes vibrations of the roller in the circumferential direction of the table.

This tendency is particularly strong in a roller mill for fine milling, because the clearance between the table and the rollers is narrowed to achieve an effective slipping force.

Another prior art vertical rolling mill is disclosed in Japanese Patent Provisional Publication No. 58-109146. This mill includes a rotatable table and rollers which have both circular and conical surfaces. The mill forms a region for coarse milling wherein the relative slip between the table and the rollers is reduced for less wear, and another region for fine milling wherein the relative slip is increased for higher milling efficiency.

It is a general object of this invention to provide an improved vertical roller mill, which has a region of slip suitable for producing fine milling between the rollers and the table, without causing circumferential vibrations of the rollers.

BRIEF SUMMARY OF THE INVENTION

A roller mill according to this invention includes a base and a table supported on the base, the table being adapted to be rotated on a generally vertical axis. The table has an annular groove formed in its top surface, the groove having a semicircular cross section. At least one roller is supported by the base above the table, each roller being rotatable on an axis which intersects with the vertical axis of the table and is fixed circumferentially of the table relative to the base. Each roller has an arcuate peripheral portion which forms part of a circle of curvature in cross section, on the outer side radially outward of the table. The roller and the table rotate on their respective axes, and they are adapted to compress and mill material in the groove between them, a clearance which receives the material being formed between the peripheral portion of the roller and the groove. The roller has an inner axial width and an outer axial width, these widths being on opposite sides of a radial plane of the roller, the center of the circle passing through the radial plane. The outer axial width is located outwardly of the plane and the inner radial width is located inwardly of the plane, and the inner width is larger than the outer width.

BRIEF DESCRIPTION OF THE DRAWINGS

Preferred embodiments of the invention are shown in the accompanying drawings, wherein.

DETAILED DESCRIPTION OF THE DRAWINGS

Figure 3:
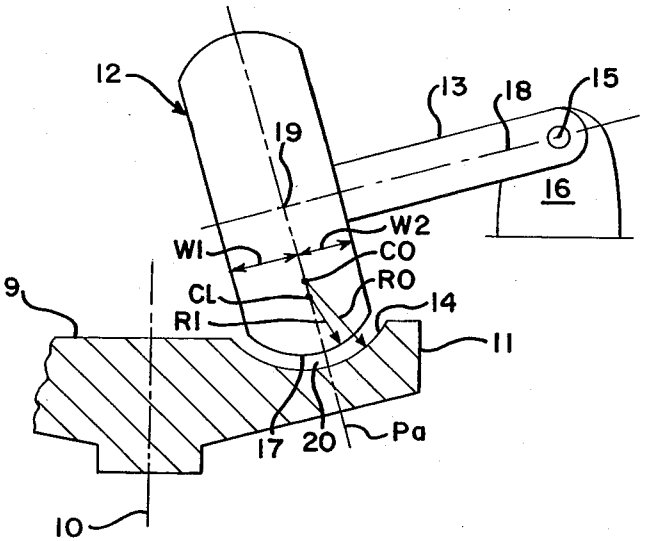
FIG. 3 is a fragmentary side view partially in cross section showing a roller mill according to a first embodiment of this invention.

With reference to FIG. 3, the mill includes a rotary table 11 made of a wear resistant metal, which is supported on a base (not shown) and during operation is driven on a vertical axis 10. The upper surface 9 of the table 11 is generally horizontal with the exception of an annular groove 14 formed therein adjacent its outer periphery. The groove 14 is semicircular when viewed in a cross sectional plane that includes the vertical axis 10 of the table, the circle having a center CO and a radius RO of curvature.

At least one roller 12 (only one shown) made of a wear resistant metal is journalled each on the end of an arm 13 that is supported by a bracket 16 which is secured to the base of the mill. The arm 13 can pivot on a pin 15 in a vertical plane which intersects with the table axis 10, but the arm is prevented from moving out of this plane.

The roller 12 has an axis 18 of rotation which in this example passes through the center of the pivot pin 15, and it has a radial plane Pa which is perpendicular to the axis 18. The intersection 19 of the axis 18 with the plane Pa is lower than the pin 15 so that the arm slants downwardly and the axis 18 and the plane Pa are at angles to the table axis 10. Material (not shown) to be milled is fed to the center area of the table 9 and it moves radially outwardly by centrifugal action, and the material enters the groove 14. The roller 12 and the arm 13 swing downwardly by the force of gravity and by conventional compression means (not shown) such as a spring or hydraulic mechanism, and the roller 12 rides on top of the material as the material moves outwardly through a narrow clearance 20 between the outer peripheral surface 17 of the roller and the groove 14. The material is thereby compressed and milled between the roller and the groove.

Normally a milling machine includes a plurality of such wheels, spaced at equal distances around the circumferences of the table.

The roller 12 has the peripheral surface 17 which is substantially semicircular in cross section, the circle having a center C1 and a radius R1 of curvature. The center Cl of curvature is located in the radial plane Pa, and the center Co of curvature of the groove 14 is also located substantially in the plane Pa. The radius R1 of the roller 12 is smaller than the radius R0 of the groove, and the clearance 20 is narrowest at substantially the radial plant Pa.

Figure 4:
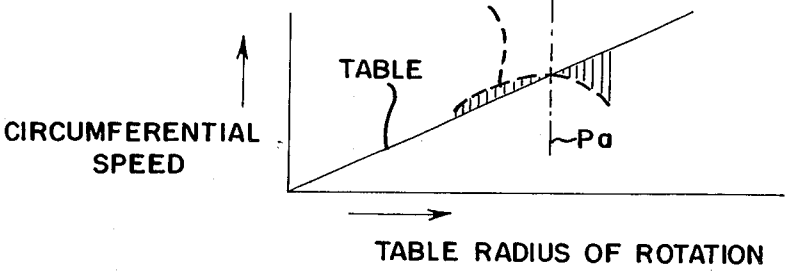
FIG. 4 is a graph showing the relation between radial distances on the table and the relative circumferential speeds of the mill shown in FIG. 3.

The side of the roller 12 which is to the left (as seen in FIG. 3) of the radial plane Pa is referred to herein as its radially inward side, and the other side which is to the right of the plane Pa is referred to as the radially outward side. The inward side is, of course, closer to the axis 10 of the table 9. As shown in FIG. 3, the roller 12 has a greater dimension (W1) on the radially inward side of the radial plane Pa than on the radially outward side (W2). The ratio of the inner width W1 of the roller to the outer width W2 is within the range between 1.1 and 2.0 and preferably between 1.2 and 1.5. This difference in widths, as shown in FIG. 4, balances the slipping forces on opposite sides of the plane Pa, there being more slippage at each point on the radially outward side. In FIG. 4, the solid line shows how the lineal or circumferential speed of the table varies with radial distance from the axis 10, and the dashed line shows this variation for different parts of the peripheral surface of the roller. At the radial plane Pa the speeds are equal in the clearance 20 and the two lines cross. The hatched areas represent the slipping forces and the areas are substantially equal on opposite sides of the plane Pa. As a result, no substantial bending moment is produced around the supporting pin 15 for the roller, and consequently the roller does not vibrate. As a result, the mill can operate safely to achieve efficient milling, and the roller 12 can be supported by a lightweight arm 13.

On the radially inward side of the radial plane Pa, the slipping force at each point can be small, thereby increasing the rate of compressive milling (ratio of the compressive force to the slipping force) for effective coarse milling. This improves the efficiency of milling on the inner side, which is a region of coarse milling.

Figure 1:
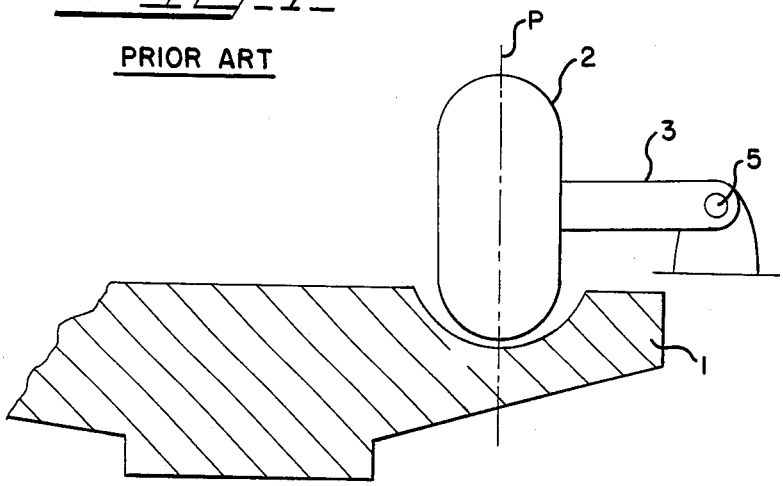
FIG. 1 PRIOR ART
FIG. 1 is a fragmentary side view partially in cross section showing a conventional roller mill.
Figure 2:
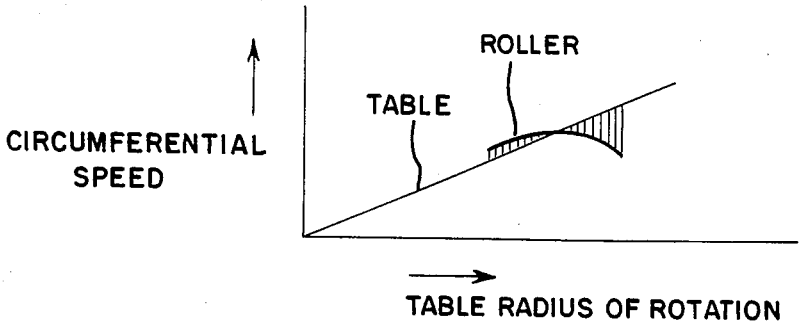
FIG. 2 is a graph showing the relation between radial distances on the table and the relative circumferential speeds of the conventional mill shown in FIG. 1.
Figure 5:
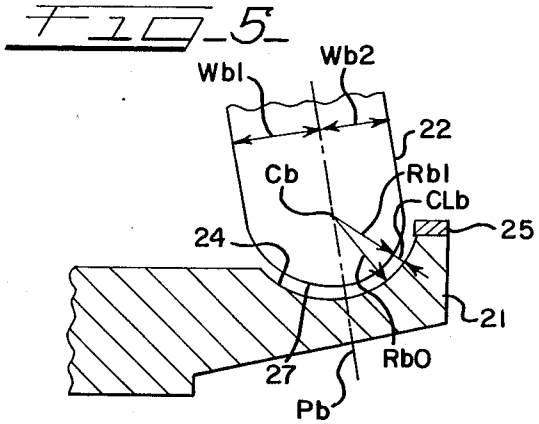
FIGS. 5 and 6 are views similar to FIG. 3, but showing second and third embodiments of the invention.

The arrangement shown in FIG. 5 is similar to that shown in FIG. 3, wherein the radially inward width Wb1 of each roller 22 is larger than the radially outward width Wb2. The roller 22 has an outer peripheral portion 27 having a radius Rb1 of curvature in cross section. The table 21 has an annular groove 24 with a radius Rb0 of curvature in cross section, which is larger than the radius Rb1. In FIG. 5, however, the groove 24 and the roller peripheral portion 27 are substantially concentric with each other in cross section and have a common center Cb of curvature at least on the radially outward side of the radial plane Pb of the roller, which side is radially outward of the axis of the table 21. The center Cb is located in the plane Pb.

On the radially outward side, because the clearance CLb between the roller 22 and groove 24 is without an outward divergence, the total slipping force is greater than in the construction of FIG. 3, thereby increasing the effect of fine milling which occurs on the outward side of the roller. Although this would cause a more serious imbalance of the slipping forces on opposite sides of the plane Pb, the imbalance is eliminated effectively by making the inner roller width Wb1 larger than the outer width Wb2, as discussed in connection with FIG. 3.

The milled material is forced to leave the outer end of the gap between the roller 22 and the groove 24 by centrifugal force and by roller pressure. The fine milling effect on the outward side is further improved by providing an annular dam or overhang 25 on the table 21 at the outer edge of the groove 24. The dam 25 is secured to the outer peripheral portion of the table, and a portion of the dam extends over the radially outward part of the clearance, and thereby restrains the material from moving radially.

Figure 6:
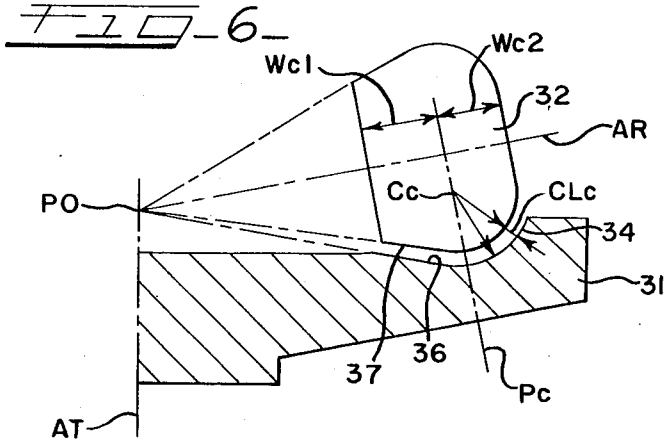

The arrangement shown in FIG. 6 is similar to that of FIG. 5, wherein the inner width Wc1 of each roller 32 is larger than the outer width Wc2. Also, the annular groove 34 of the table 31 and the peripheral portion of the roller 32 are substantially concentric with each other in cross section around a common center Cc of curvature, at least on the radially outward side of the radial plane Pc of the roller 32, in which plane Pc is located the center Cc.

On the outward side, the clearance Clc between the roller 32 and groove 36 is constant, so that a sufficient slipping force is applied to the material being milled, similarly to FIG. 5. This allows effective fine milling.

In FIG. 6, the table axis AT of rotation and roller axis AR intersect at a point PO. At least partially on the radially inward side of the radial plane Pc, which is radially inward of the table 31, the table groove 34 has a conical surface 36 of a cone which would be formed around the table axis AT with its apex at PO. The conical surface 36 is tangent to the circle of curvature of the groove 34 in axial cross section.

At least partially on the radially inward side of the plane Pc, the roller 32 also has a conical surface 37 of a cone which would be formed around the roller axis AR, and which also has its apex at PO. The conical surface 37 is tangent to the circle of curvature of the roller 32 in axial cross section.

This configuration causes substantially no slip between the roller and groove at least partially on the radially inward side of the plane Pc. However, the wide conical surfaces 36 and 37 produce a great compressive force in total therebetween relative to the slipping force on the outward side of the plane Pc. Consequently, the roller 32 can rotate substantially without vibrations.

It is preferred to form the conical surfaces 36 and 37 mainly on the radially inward side from the plane Pc, so that the coarse milling is very effective. On the radially outward side of the plane Pc, the clearance CLc may otherwise narrow outwardly to increase the slipping force.

In all of the embodiments disclosed herein, the portion of the table which is radially outwardly from the annular groove has a higher upper surface than the portion which is radially inwardly of the groove.

What is claimed is:

1. A roller mill comprising a base, a table supported on said base and adapted to be rotated on a substantially vertical axis, said table having an annular groove formed in the top surface thereof, a roller arms means connected to said roller for supporting said roller on said base for rotation on an axis which intersects said vertical axis, said roller having an outer peripheral portion which forms part of a circle of curvature in cross section on the outer side which is radially outward of said table, said roller being adapted when in use to rotate in said groove and to compress material against said groove and rotate with said table, whereby a clearance is formed between said peripheral portion and said groove and said clearance is filled with the material, said roller having a radial plane which passes through the center of said circle of curvature and is fixed circumferentially of said table relative to said base, said roller being axially wider on the radially inward side of said plane than on the radially outward side of said plane and, at least partially on said radially outward side of said table, said annular groove forming part of a circle of curvature and said circle of curvature of said groove being substantially concentric with said peripheral portion of the roller in cross section.

2. A roller mill according to claim 1, wherein said peripheral portion of the roller has a conical surface, which is tangent to said circle of curvature of said portion, at least partially on said radially inward side of the table, and said annular groove has a conical surface, which is tangent to said circle of curvature of the groove, at least partially on said radially inward side.

3. A roller mill according to claim 1, and further comprising a dam provided on said table adjacent the outer periphery of said annular groove to narrow the clearance between said roller and groove.

4. A roller mill according to claim 1, wherein the ratio of the width of said inward side of the roller to the width of said outward side is substantially in the range of 1.1–2.0.

5. A roller mill according to claim 4, wherein said ratio is between 1.2–1.5.

6. A roller mill for crushing material, comprising a table adapted to be rotatably driven on a substanially vertical axis, the table being adapted to receive the material in a central area around said axis, said table having a substantially horizontal upper surface and an annular groove being formed in said upper surface radially outwardly from said central area, said groove having a curved bottom surface, at least one roller, arm means connected to said roller for supporting said roller on a relatively fixed axis of rotation which is above said upper surface and inetersects said vertical axis, said rolller extending into said groove and having an outer peripheral surface which is curved in cross section, said mill when in use having said table and said roller rotated and the material extending into a clearance space formed between said peripheral surface and said bottom surface, said roller having a radial plane therethrough which plane extends through said clearance at a location where the circumferential speed of said roller equals the circumferential speed of said table, and the width of said roller on the radially inward side of said plane being greater than the width on the radially outward side of said plane, said clearance being substanially constant in cross section at least partially on said outward side.

7. A roller mill according to claim 6, wherein said surfaces are substanially circular on said outward side of said plane, and the centers of the circles being substanially on said radial plane.

8. A roller mill according to claim 6, wherein the ratio of said width of the roller on said inward side to said outward side is substantially in the range of 1.1–2.0.

9. A roller mill according to claim 8, wherein said ratio is between 1.2–1.5.

* * * * *